United States Patent [19]

Steele et al.

[11] Patent Number: 4,861,008

[45] Date of Patent: Aug. 29, 1989

[54] VACUUM SUPPORT TABLE FOR GLASS GLAZING AND THE LIKE

[76] Inventors: Willard A. Steele; Jeffrey S. Steele, both of 35082 S. Turtle Dr., Willoughby, Ohio 44094

[21] Appl. No.: 136,288

[22] Filed: Dec. 22, 1987

[51] Int. Cl.[4] ..... B25B 11/00

[52] U.S. Cl. ..... 269/21; 269/308

[58] Field of Search ..... 269/21, 308, 309, 900, 269/909

[56] References Cited

U.S. PATENT DOCUMENTS 4,705,438 11/1987 Zimmerman et al. ..... 269/21 X

*Primary Examiner*—Eugene R. LaRoche
*Assistant Examiner*—Robert J. Pascal
*Attorney, Agent, or Firm*—Watts, Hoffmann, Fisher & Heinke Co.

[57] ABSTRACT

A glazing table of the type for supporting a window pane, plate or window assembly thereof, said table including a support frame having a pair of oppositely disposed support columns, an elongated hollow manifold member rotatably journaled on said columns adapted for pivotally mounting said table, a base member fixedly attached to said rotatable manifold member, a resilient platen member made from an elastomeric or polymeric material attached to said base member, a plurality of vacuum ports extending through said base and resilient platen members, and a vacuum supply source for automatically applying a vacuum confronting undersurface of a glass plate or panel mounted on said base member.

4 Claims, 8 Drawing Sheets

VACUUM SUPPORT TABLE FOR GLASS GLAZING AND THE LIKE

DESCRIPTION

1. Technical Field

The present invention relates to support devices and more particularly relates to a stationary and/or tiltable support table of the type utilizing a vacuum for glazing glass pieces and the like.

2. Background of the Invention

The present invention relates to a glazing table for the assembly of various types of glass pieces including glass sliding doors and the like. Heretofore, it has been known to provide various types of support tables for supporting glass pieces including sliding doors and the like. However, such tables have generally been of a rigid or stationary type without the provision of any type of automatic system for retaining the glass pieces or panels in position during the assembly and/or glazing thereof.

Accordingly, the present invention provides a support table which incorporates a vacuum system that minimizes set-up time and various of the known manual and/or mechanical techniques for holding the glass panel, for example, in respect to the weather stripping seals. The invention incorporates such a vacuum system which acts to draw the glass evenly against a bottom seal and hence, acts to pre-load the glass for upper seal installation.

In the invention, a resilient surface is provided that gives a positive vacuum seal between the platen surface and the window frame. The platen member includes a resilient platen surface made of a polymeric or elastomeric member which has a plurality of vacuum ports that are preferably recessed below the general plane of the resilient platen surface so as to maximize the vacuum drawing against the confronting underlying surface of the glass piece to be installed.

In the invention, the glazing table may be of a stationary configuration for certain applications or of a tiltable configuration which is automatically tilted to the desired operating position by a suitable electric drive motor.

Other advantages and objects of the present invention will become apparent as the following description proceeds taken in conjunction with the accompanying drawings.

DESCRIPTION OF THE PREFERRED EMBODIMENTS

Figure 1:
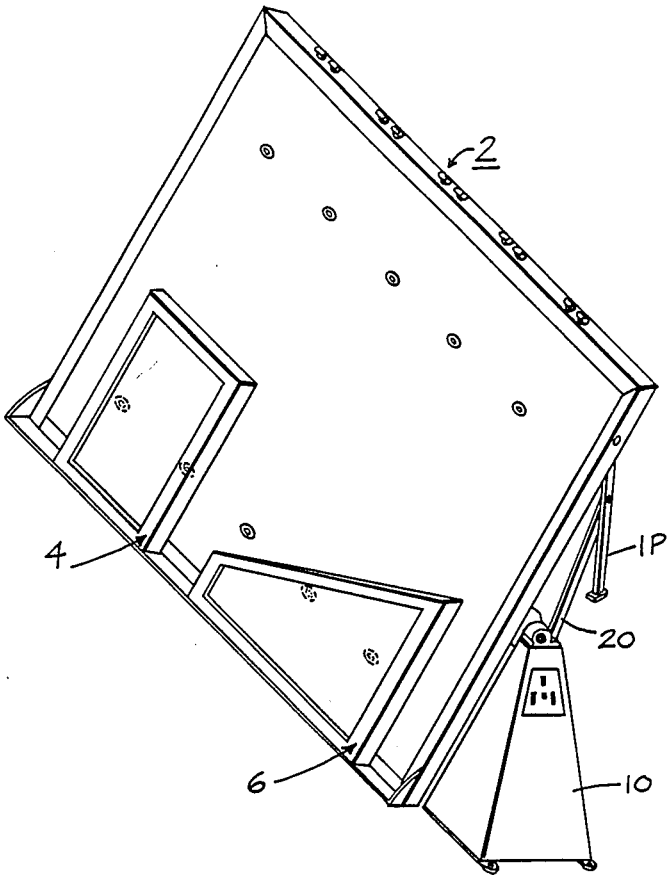
FIG. 1 is a generally perspective view of one embodiment of the glazing table of the invention.
Figure 2:
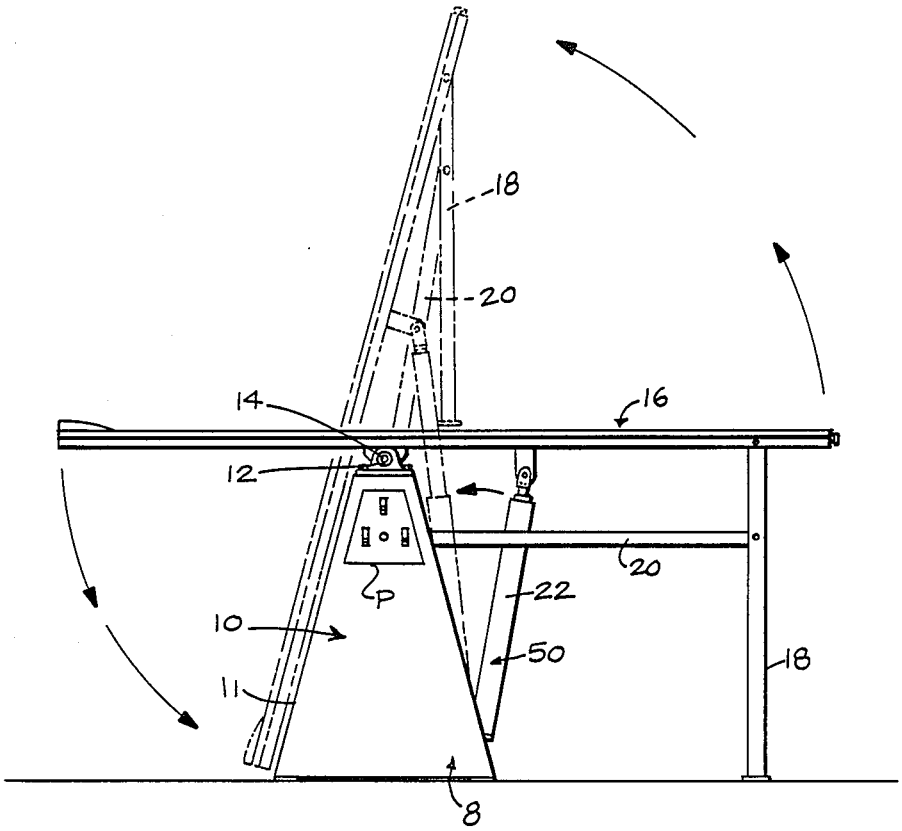
FIG. 2 is a side elevation view of one embodiment of the glazing table in a tilted position.
Figure 12:
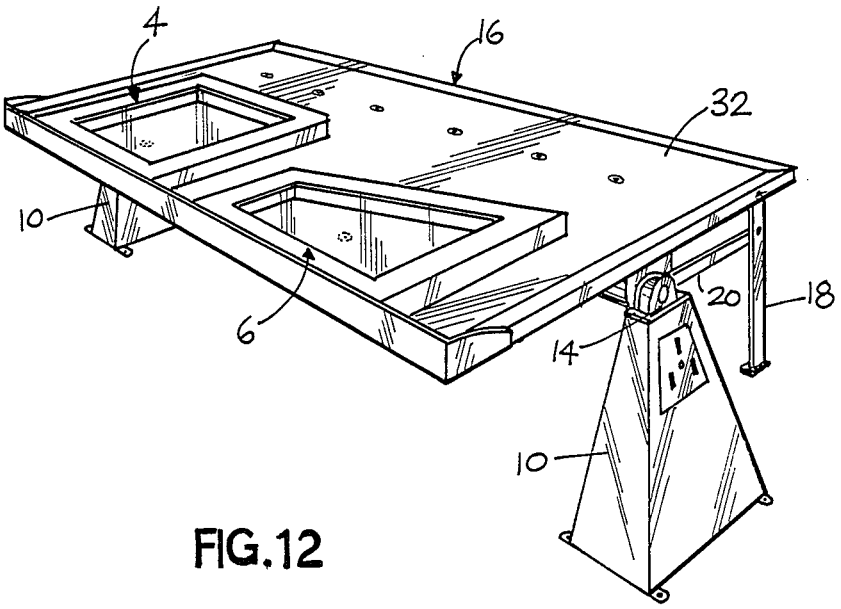
FIG. 12 is a generally perspective view of the rigid or stationary embodiment of the glazing table in accordance with the invention.

Referring again to the drawings and particularly to FIGS. 1, 2 and 12 thereof, there is illustrated a glazing table, designated generally at 2, for supporting a glass piece such as a sliding glass panel or the like on the support surface. As an example, a pair of various shaped window assemblies are designated at 4 and 6 in FIG. 1 mounted on the support surface of the table.

In general, the support table includes a support frame, designated generally at 8, which may include a pair of oppositely disposed support columns, as at 10, which have bearings, as at 12, for pivotally mounting, as at 14, a support frame 16 thereon. To further stabilize the support frame 16 in the horizontal position, a leg 18 and bracket arm 20 may be provided to support the outer end of the support frame 16, as desired. It is recognized, however, that this leg and bracket assembly may not be necessary since it is possible that the hydraulic cylinder, designated generally at 22, can maintain the support frame 16 in the horizontal position, as illustrated in FIGS. 2 and 12.

Figure 3:
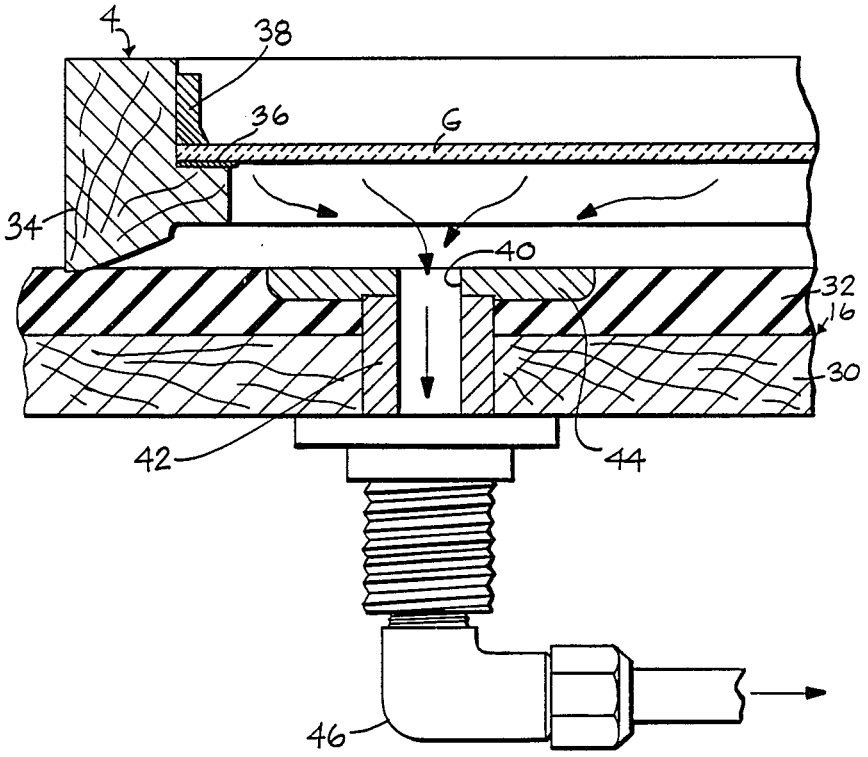
FIG. 3 is an enlarged, fragmentary horizontal section view illustrating the vacuum port in conjunction with the resilient platen member of the present invention.
Figure 4:
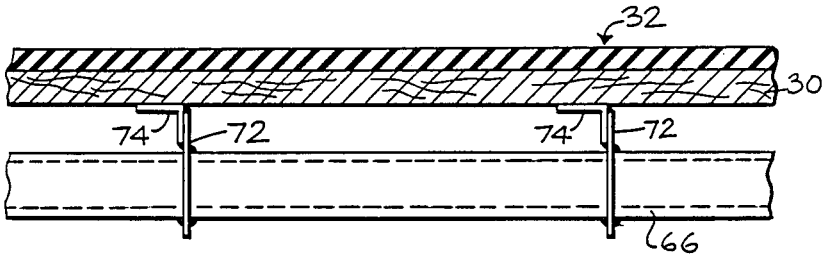
FIG. 4 is a fragmentary, horizontal section view illustrating the resilient platen member supported on the base member.

As best illustrated in FIG. 3, the support frame 16 includes a flat platen member 30 which may be made of metal, wood or the like and which supports thereon a resilient platen support member 32 which may be made of a resilient elastomeric or polymeric material. This resilient platen member 32 covers the entire surface of the support member and provides a resilient cushion for the window assembly, such as at 4, supported thereon. For example, the window assembly 4 includes a window frame 34 made from wood, aluminum or the like which seats upon the resilient platen member 32. This provides a pneumatic seal between these component parts. The window frame 34, in turn, supports a glass panel G which rests upon a seal 36 with suitable weatherstripping 38 installed over and around the periphery of the window panel in the installed position thereof.

As illustrated, a series of vacuum ports, as at 40, extend through the resilient platen 32 and base member 30 and are each defined by a suitable coupling, as at 42, and a horizontal collar or flange 44 which flange provides a recess in the resilient material of the platen member 32 so as to maximize the vacuum force applied to the confronting underside of the glass panel in situations where the glass panel is laid directly onto the resilient platen member 32. A suitable fitting, as at 46, is operably connected to the vacuum port 40 for connection to the vacuum control system in accordance with the invention.

Figure 6:
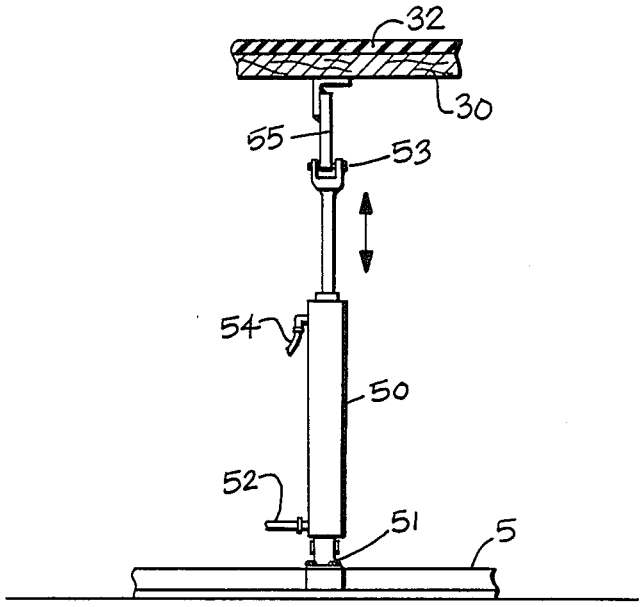
FIG. 6 is a fragmentary, elevation view illustrating one of the hydraulic cylinders for tilting the brazing table in accordance with the invention.
Figure 7:
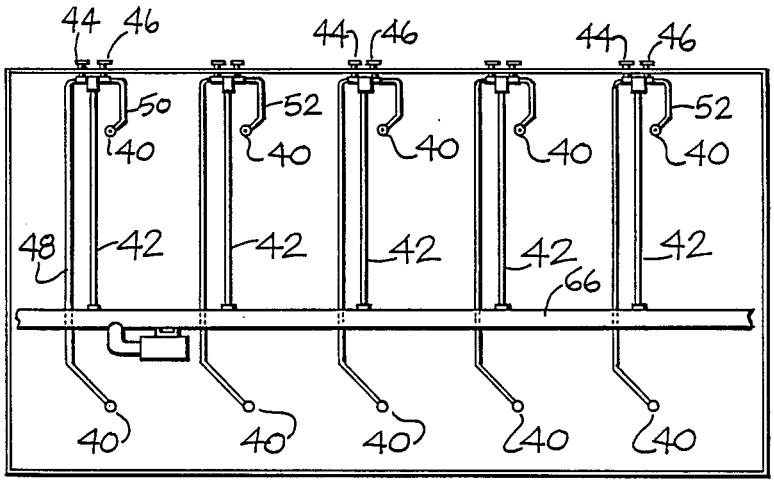
FIG. 7 is a top plan view of the control system in accordance with the invention.
Figure 11:
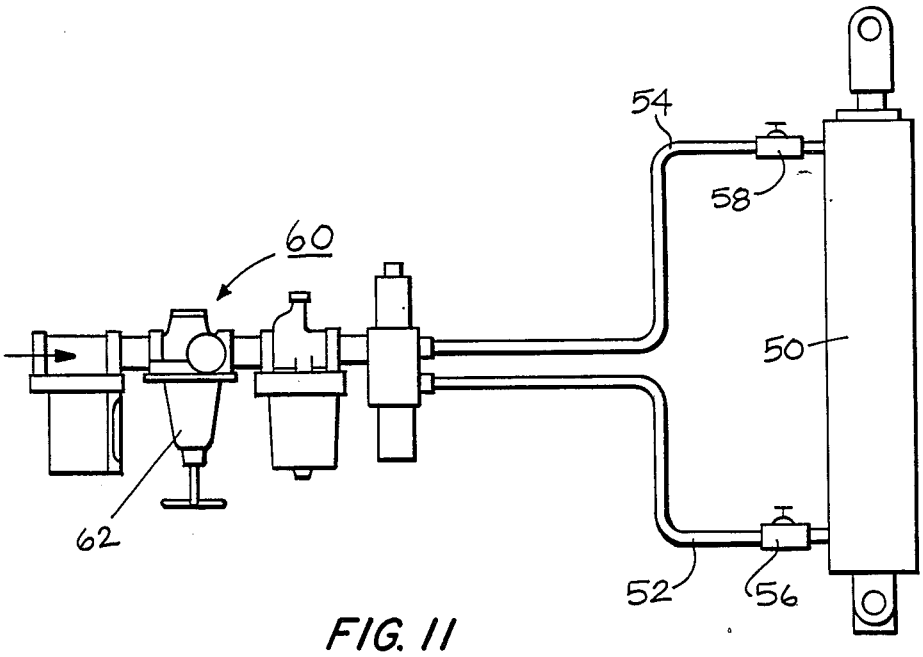
FIG. 11 is a fragmentary schematic view of the fluid control for the power cylinder in accordance with the present invention.

As best seen in FIG. 6, a hydraulic cylinder 50 may be fixedly attached, as at 51, to the base frame 5 and pivotally connected, as at 53, at its opposite end via a link member 55 to the base frame 30. The cylinder 50 is provided with conventional inlet and outlet ports 52 and 54 for reciprocating the cylinder upwardly and downwardly thereby to tilt the table from a horizontal position into the generally inclined position illustrated in FIG. 2. That is, the table is pivoted in a counterclockwise direction from the horizontal into an inclined position which is generally parallel to the inclined surface defined by the sidewall 11 of the support columns 10. As best seen in FIG. 11, the cylinder 50 has control valves 56 and 58 for adjusting the fluid pressure to the cylinder and a suitable control system, designated generally at 60, having a manual control valve 62 for regulating the fluid pressure to the cylinder 50.

Figure 5:
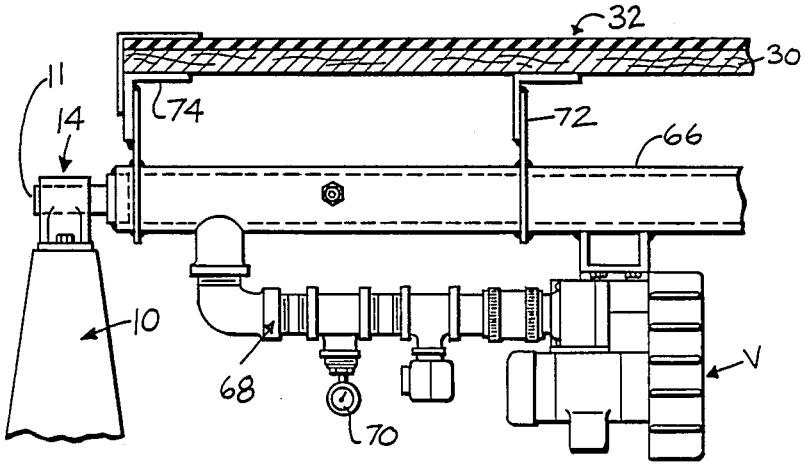
FIG. 5 is a fragmentary, vertical section view illustrating a portion of the fluid control system of the invention.

As best illustrated in FIG. 5, a cylindrical manifold member 66 is provided to act not only as a support axle for the table but also as a fluid manifold for the vacuum ports 40. As shown the fluid manifold 16 communicates with a series of primary conduits 42 which communicate via control valves 44 and 46 with secondary conduits 48 and 52 which communicate with the vacuum ports 40. In the example shown, 10 vacuum ports are illustrated but any number or arrangement of ports may be utilized, as desired.

The manifold 66 communicates via suitable fittings, as at 68 (FIG. 5), with a suitable self-regulating vacuum pump which may be of a 1½ horse power size so as to draw a vacuum from 0 to 50 inches of mercury. The pump may have a 90 cfm evacuation rate in this range. Accordingly, the vacuum pump P may have a suitable regulator, as at 70, for controlling the amount of vacuum drawn via the ports 40 and hence, upon the glass panel to be assembled.

In the invention, the support table is rigidly attached to the manifold 66 via plate elements 72 welded to the manifold which are, in turn, welded to L-brackets 74 attached to the underside of the base or frame member 30. Accordingly, the manifold includes integral axle members 11 for mounting in the bearings 12 to enable pivotal movement of the table relative to the supporting columns 10.

Figure 8:
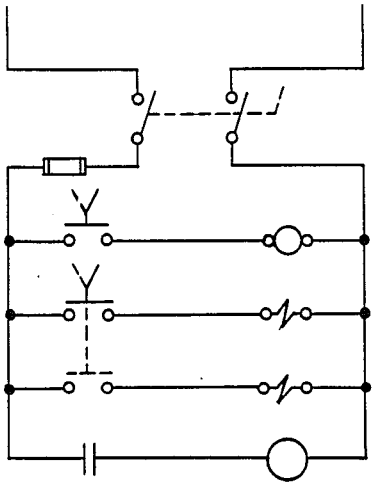
FIGS. 8, 9 and 10 are schematic views of the electrical circuit for actuating the vacuum control system and tilting mechanism in accordance with the invention.
Figure 9:
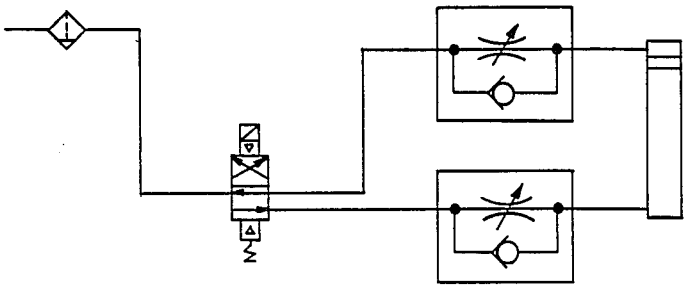
Figure 10:
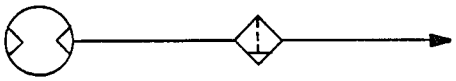

In FIGS. 8, 9 and 10 there is illustrated electrical schematic diagrams for controlling actuation of the fluid cylinder 50 via a control panel, as at P, mounted on one of the columns and for controlling the vacuum pump V for drawing the required vacuum on the ports 40. The electrical control circuits may be of any conventional design as known in the art for controlling automatically actuation of the cylinder 50 and the vacuum pump V.

Accordingly, it will be recognized that the glazing table of the present invention may be utilized in the rigid or stationery position or in a tilted form to facilitate loading and unloading of the window assembly and/or to facilitate working on the widow assembly, as desired.

We claim:

1. A glazing table of the type for supporting a window pane, plate or window assembly thereof, said table including a support frame having a pair of oppositely disposed support columns, a single elongated hollow manifold member rotatably journaled on said columns adapted for pivotally mounting said table, a base member fixedly attached to said rotatable manifold member having a resilient material thereon, a resilient platen member made from an elastomeric or polymeric material attached to said base member, a plurality of vacuum ports extending through said base and resilient platen members, and a vacuum supply source for automatically applying a vacuum to said vacuum ports adapted for drawing a vacuum against the confronting undersurface of a glass plate or panel mounted on said base member, wherein said manifold member is of a hollow construction including a plurality of conduits connecting said vacuum ports to a vacuum motor, and said manifold member having axle members at the opposed ends thereof adapted for mounting in bearings mounted on said support columns and wherein said vacuum ports include a horizontal collar which holds said resilient platen member in a recessed condition around the periphery thereof.

2. A glazing table in accordance with claim 1, wherein said base member is pivotally mounted for rotational movement about a horizontal axis, futher comprising fluid cylinder means adapted for pivoting said base about said horizontal axis, and a said collar defining a recess in said resilient material of said platen member to maximize the vacuum force applied to the confronting undersurface of the glass panel where the glass panel is laid directly onto said resilient platen member.

3. A glazing table of the type for supporting a window pane, plate or window assembly thereof, said table including a support frame having a pair of oppositely disposed support columns, a single elongated hollow manifold member rotatably journaled in said columns adapted for pivotally mounting said table, a base member fixedly attached to said rotatable manifold member, a resilient platen member made from a resilient elastomeric or polymeric material attached to said base member, a plurality of vacuum ports extending through said base member and said resilient platen members, a vacuum source for automatically applying a vacuum to said vacuum ports and adapted for drawing a vacuum against the confronting undersurface of a glass plate or panel mounted on said base member, said manifold member being of a hollow construction including a plurality of conduits connecting said vacuum ports to a vacuum motor, the manifold member having axle members at opposed ends thereof adapted for mounting in bearings mounted on said support columns and wherein said vacuum ports include a horizontal collar which holds said resilient platen member in a recessed condition around the periphery thereof, and control means for regulating the vacuum pressure drawn on said vacuum ports.

4. A glazing table in accordance with claim 3, including a leg member pivotally connected to the support frame for holding the frame in a fixed horizontal position during normal use thereof.

* * * * *